US005564683A

United States Patent [19]

Stuck

[11] Patent Number: 5,564,683

[45] Date of Patent: Oct. 15, 1996

[54] ROTATABLE REPAIR APPARATUS FOR SNOWMOBILES

[76] Inventor: Andrew G. Stuck, 2627 N. Birchwood Ave., Appleton, Wis. 54914

[21] Appl. No.: 332,868

[22] Filed: Oct. 31, 1994

[51] Int. Cl.[6] ..... B25B 1/00

[52] U.S. Cl. ..... 269/17; 269/296; 269/287; 269/909; 269/131; 269/69; 269/76

[58] Field of Search ..... 269/17, 296, 287, 269/130, 131, 69, 246, 275, 286, 76, 909, 302, 71, 55; 254/94, 422; 414/758, 764, 765, 766, 767

[56] References Cited

U.S. PATENT DOCUMENTS

| | | | |
|---|---|---|---|
| Re. 33,930 | 5/1992 | Ardent . | |
| 1,236,246 | 8/1917 | Amelung . | |
| 1,288,138 | 12/1918 | Nicoson . | |
| 2,182,743 | 12/1939 | Clergy . | |
| 2,301,019 | 11/1942 | Couse | 269/17 |
| 2,742,635 | 4/1956 | Capps . | |
| 4,307,877 | 12/1981 | Rogos | 269/296 |
| 4,491,307 | 1/1985 | Ellefson . | |
| 4,686,925 | 8/1987 | Stuck . | |
| 5,135,205 | 8/1992 | Bedard | 269/17 |
| 5,328,161 | 7/1994 | Stuck . | |
| 5,383,653 | 1/1995 | Stuck | 269/17 |

FOREIGN PATENT DOCUMENTS

| | | | |
|---|---|---|---|
| 1007838 | 4/1977 | Canada . | |
| 716968 | 2/1980 | U.S.S.R. | 269/17 |

*Primary Examiner*—Robert C. Watson
*Attorney, Agent, or Firm*—Andrus, Sceales, Starke & Sawall

[57] ABSTRACT

A rotatable apparatus for servicing or repair of snowmobiles. The apparatus includes a frame or rack, having a pair of generally parallel curved frame members which are located along a side of the snowmobile. Adjustable connecting bars connect the corresponding upper and lower ends of the curved frame members together. A base plate is secured to the lower end of the front frame member and is disposed to be positioned beneath a ski of the snowmobile. A pair of clamping screws are connected to a bracket attached to the front frame member and are adapted to clamp the ski against the base plate. An adjustable cushioned support member is connected to the front frame member above the base plate and is adapted to engage the suspension of the snowmobile, while a rear support member is connected to the rear frame member and is positioned to engage the running board and seat of the snowmobile. A flexible strap connects opposite sides of the snowmobile to the frame. With the snowmobile clamped to the frame, the frame can be manually rotated to tilt the snowmobile to a position where components on the undersurface of the snowmobile can be serviced.

17 Claims, 5 Drawing Sheets

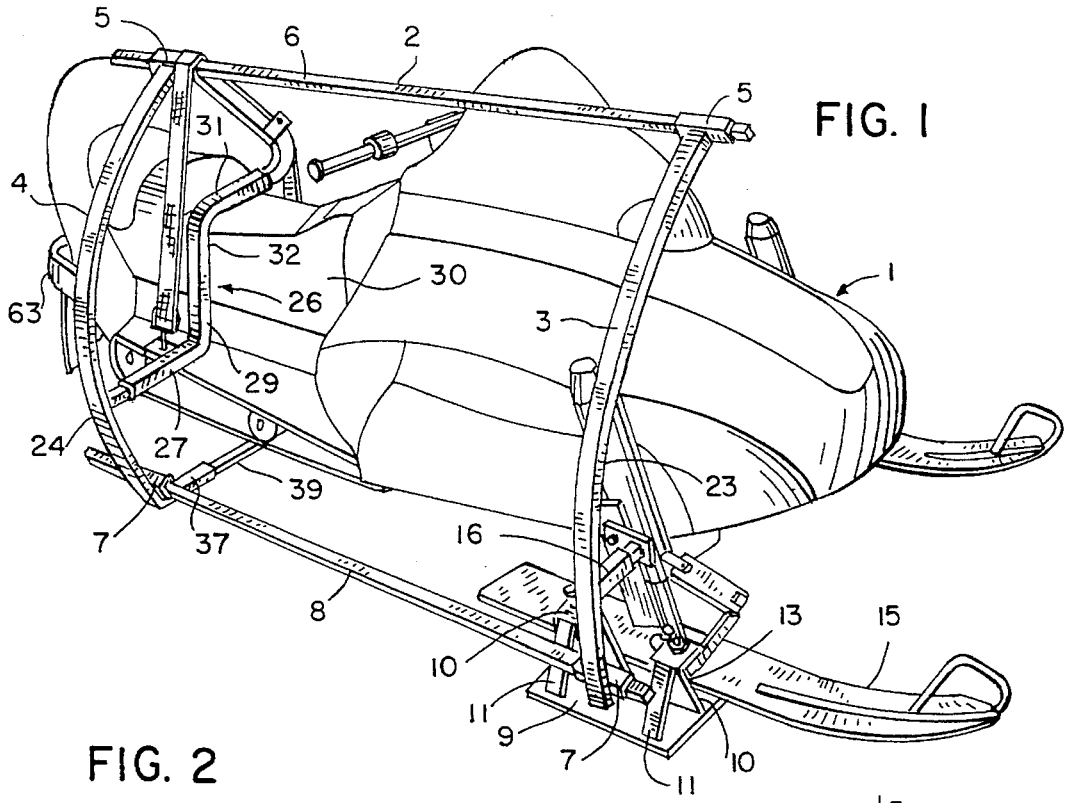
FIG. 1
FIG. 2
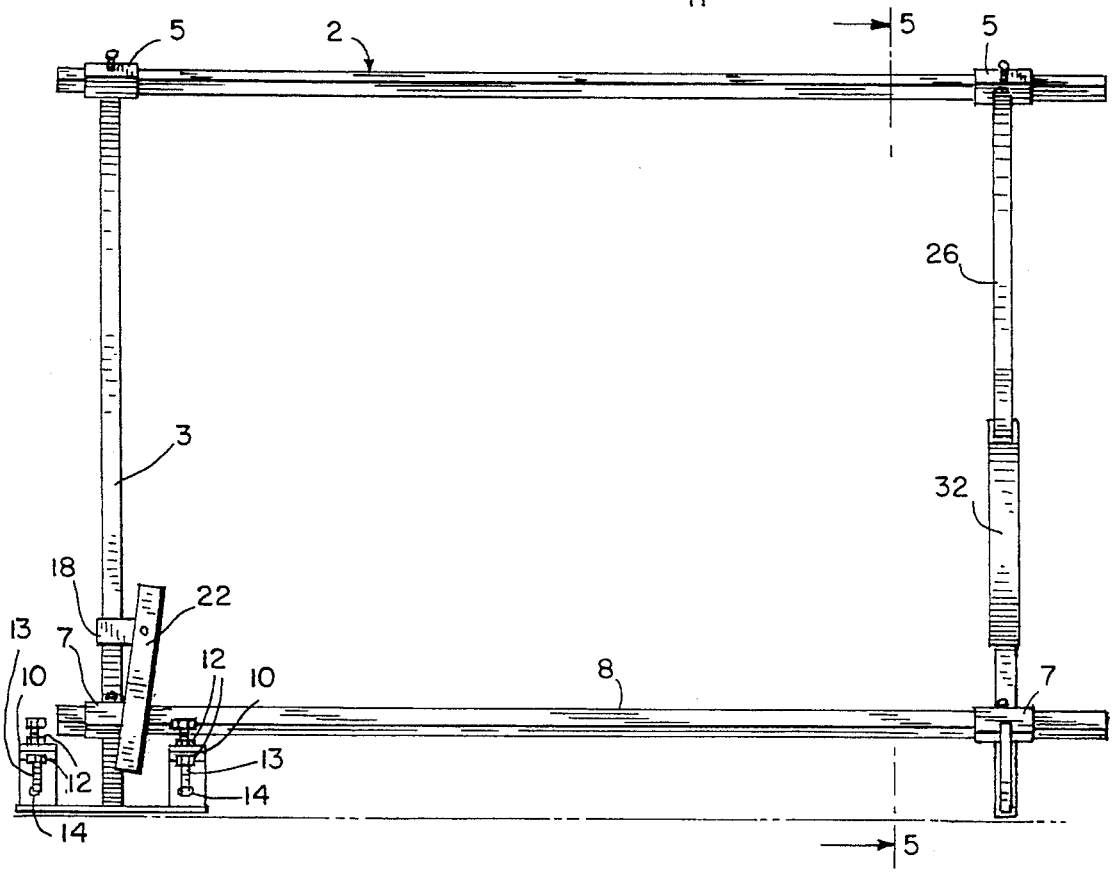

ROTATABLE REPAIR APPARATUS FOR SNOWMOBILES

BACKGROUND OF THE INVENTION

It is often necessary to service or repair components on the underside of a snowmobile, such as the suspension or track, and in order to facilitate service of these components, the normal practice is to tilt the snowmobile.

With the purchase of a new snowmobile, the purchaser will frequently require that metal studs be installed in the snowmobile track. To install the studs, it is also necessary to tilt the snowmobile to a position where the track is accessible.

In the past, snowmobiles have been tilted manually for service or repair and propped up in the tilted condition against an object such as a box, tires, or the like. Not only is the snowmobile in this tilted condition relatively unstable, but supporting the snowmobile in this manner can result in damage to the snowmobile. For example, upholstery can be ripped, decals on the body panel can be scratched, the handle grips, which normally have electric heating elements, can be damaged, or the windshield can be cracked or broken.

Another attempt to provide access to the under-surface of the snowmobile has been to lift the rear end of the snowmobile through a suitable hoisting mechanism and hang the snowmobile vertically. However, this type of support puts undue stress on the chassis of the snowmobile.

It has also been proposed to lift the snowmobile and rest the front and rear ends of the snowmobile on tables, or other supports. With this method it is necessary for the workmen to crawl beneath the snowmobile and then work in an overhead position, which is awkward.

Rotary repair devices have been used in the past to repair or service watercraft. U.S. Pat. No. 4,686,925 describes a rotary repair rack consisting of a pair of parallel rings. A boat to be serviced is moved by a crane, or other hoisting mechanism into the area within the rings, and then clamped to the rings. The rings are then rotated through a power mechanism to invert the boat for servicing.

U.S. Pat. No. 5,328,161 describes a manually rotatable device for servicing a smaller watercraft, such as a jet ski. The device, as disclosed in this patent, includes a frame composed of a pair of rings, with each ring having a pair of diametrically opposed flat portions. With the device, the rings, with corresponding flat portion facing the terrain, are inserted over the ends of the watercraft and the rings are then connected together by connecting bars. The watercraft is then clamped to the rings and the rings are manually rotated to bring the second flat portions into contact with the terrain and invert the watercraft for service.

SUMMARY OF THE INVENTION

The invention is directed to a rotary rack or apparatus for repairing a vehicle such as a snowmobile. The apparatus includes a frame having a pair of generally parallel curved frame members, which are located laterally of a side of the snowmobile. The upper and lower ends of the two curved frame members are connected together by adjustable connecting bars.

Secured to the lower end of a first of the frame members is a base plate which is adapted to be positioned beneath a ski of the snowmobile. The ski is clamped to the base plate by a clamping mechanism carried by the first or front frame member and consisting of a pair of clamping screws. By threading down the screws, the screws will clamp the ski to the base plate.

A front support member is mounted on the first or front frame member above the base plate and carries an adjustable support bar that is adapted to engage the suspension for the snowmobile ski. The support bar can be adjusted universally relative to the front frame member to accommodate various types of snowmobile suspensions.

A base bar is removably connected to the lower end of the second or rear frame member and is adapted to be positioned beneath the track of the snowmobile. Also connected to the rear frame member above the base bar is a rear support member that is adapted to engage and support the rear portion of the snowmobile. More specifically, the rear support member includes a lower horizontal section that engages the running board of the snowmobile, a vertical section that engages the side of the snowmobile seat, and an upper horizontal section which engages the upper surface of the seat.

In addition, a flexible clamping strap is connected to opposite sides of the rear portion of the snowmobile and is engaged with the frame. By tightening the strap, the rear portion of the snowmobile will be clamped tightly against the rear support member.

With the snowmobile clamped to the frame, the frame can then be manually rotated through an angle of about 45° to 90° to position the snowmobile for servicing of components on its undersurface. If the frame is rotated to an angle of about 45°, chock members can be engaged with the lower ends of the two curved frame members to prevent the frame and snowmobile from rolling back to its original position. However, if the frame is rotated to an angle of about 90°, the center of gravity of the snowmobile will retain the frame and snowmobile in this position without the need for the chocking members.

Through use of the invention, components on the undersurface of the snowmobile, such as the track and suspension, are accessible for repair or service. Moreover, the snowmobile can be moved to the tilted position without damage to the components of the snowmobile.

Through use of the rack of the invention, the snowmobile can be tilted manually by a single workman and without the requirement of power operated equipment.

As a further advantage, the rack can be adjusted to accommodate all models and types of snowmobiles, Other objects and advantages will appear in the course of the following description,

DESCRIPTION OF THE DRAWINGS

The drawings illustrate the best mode presently contemplated of carrying out the invention. In the drawings:

FIG. 1 is a perspective view showing the rotary repair apparatus of the invention as associated with a snowmobile;

FIG. 2 is a side elevational view of the apparatus;

DESCRIPTION OF THE ILLUSTRATED EMBODIMENT

Figure 3:
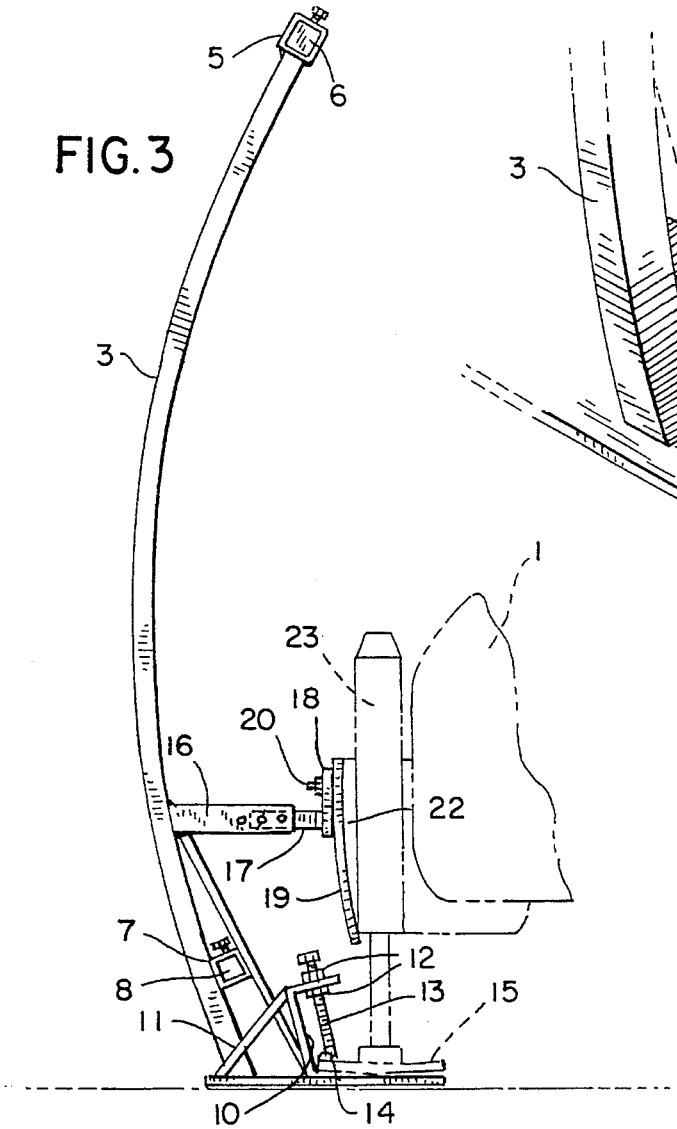
FIG. 3 is a front end view of the apparatus.
Figure 10:
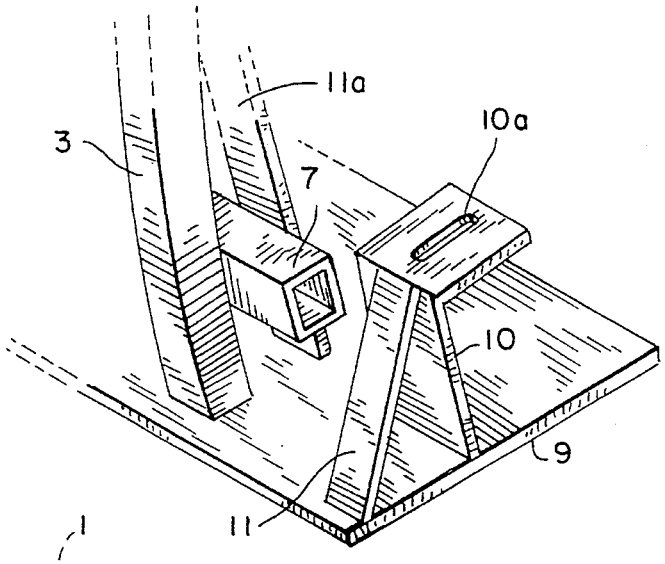
FIG. 10 is a perspective view of the ski clamping mechanism.

The drawings illustrate a rotary apparatus or rack for servicing a vehicle, such as a snowmobile 1. The apparatus consists of a tubular frame 2 including a curved front frame member 3 and a generally parallel curved rear frame member 4. Frames 3 and 4 each extend through an arc of about 90° and are positioned laterally of the snowmobile 1. Frame members 3 and 4 are preferably composed of metal tubing having a square cross section.

Mounted on the upper end of each frame member 3,4 is an upper socket 5 having a square cross section and an upper connecting bar 6, also having a square cross section, is received within the sockets 5. Similarly, a lower socket 7 having a generally square cross section is connected to the lower end of each frame member 3,4 and a lower connecting bar 8 is received within the sockets 7. The sliding connection of the connecting bars 6 and 8 with the sockets 5 and 7, enables the frame members 3 and 4 to be adjusted in a direction toward and away from each other to accommodate different models of snowmobile. Connecting bars 6 and 8 can be secured within the respective sockets 5 and 7 by thumb screws.

Mounted on the lower end of front frame member 3 is a base plate 9. A pair of angle brackets 10 extend upwardly from base plate 9 on either side of frame member 3 and each angle bracket 10 is supported by a brace 11 which is connected between the angle bracket and the base plate 9. In addition, a brace 11*a* is welded to frame member 3 and to socket 7, and the lower end of brace 11*a* is welded to plate 9 between the angle brackets 10. The upper leg of each angle bracket 10 is provided with a slot 10*a* and threaded nuts 12 are positioned in alignment with the slot 10*a* on either side of the upper leg. A clamping screw 13 is engaged with the nuts. The lower end of each screw 13 is provided with a rubber tip 14 which is adapted to engage the upper surface of a ski 15 of snowmobile 1. By threading down the screws 13, the ski 15 will be clamped against the base plate 9.

Figure 4:
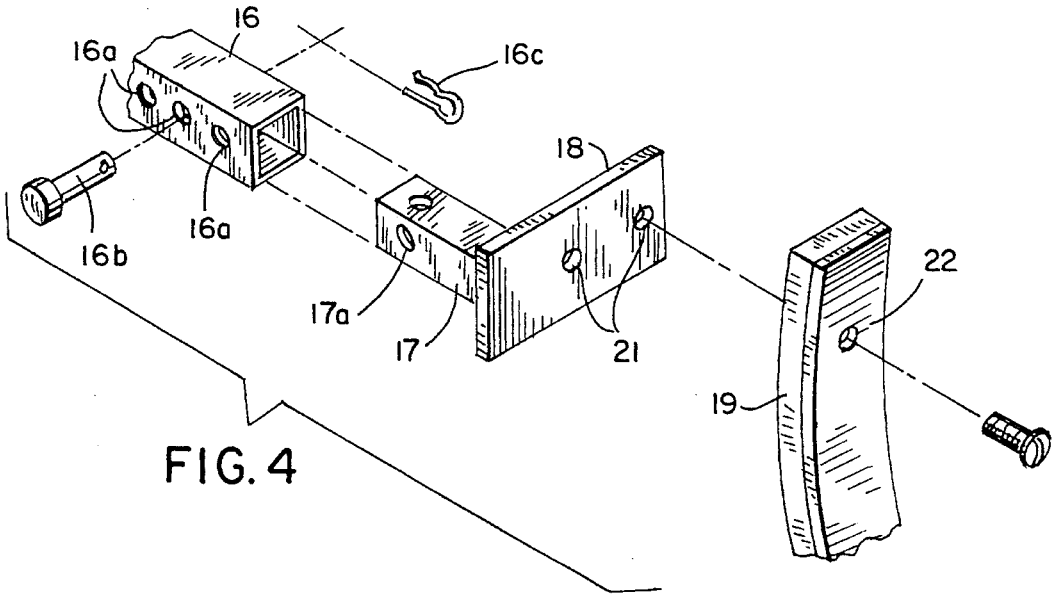
FIG. 4 is an exploded view showing the connection of the front support member.

A tube 16 having a square cross section is mounted on front frame member 3 above base plate 9 and extends inwardly toward snowmobile 1. As best seen in FIG. 4, a bar 17 having a square cross section is received within tube 16, and the outer end of the bar 17 carries a plate 18. To provide lateral adjustability for plate 18, tube 16 is provided with a series of aligned holes 16*a* and a pin 16*b* can be inserted through one of the pair of holes 16*a*, as well as through a hole 17*a* in bar 17. Pin 16*b* is retained in the holes by cotter pin 16*c*. A support bar 19 is adjustable connected to plate 18 by a bolt 20 that is inserted through a hole in bar 19, as well as through one of a pair of spaced holes 21 in plate 18. Bar 19 is provided with a resilient pad or cushion 22 which is adapted to engage the suspension 23 or frame of the snowmobile ski.

Plate 18 and bar 19 provide adjustability to accommodate various types of snowmobile suspension. The connection of bar 17 to tube 16 through pin 16*b* provides lateral adjustment. The square contour of tube 16 and bar 17 enables plate 18 to be adjusted to four different positions relative to tube 16, and the connection of bar 19 through bolt 20 to plate 18 enables the bar to be adjusted relative to the plate. Thus, the bar 19 can be universally adjusted in order to engage the suspension 23 or frame of the snowmobile 1.

A lower tube 24 and an upper tube 25, both having square cross sections, are secured by welding to rear frame member 4, and a rear support bar 26 also having a square cross section is telescopically connected to the tubes 24 and 25. Support bar 26 is provided with a lower horizontal section 27 that is adapted to engage the running board 28 on the snowmobile and a vertical section 29 extends upwardly from horizontal section 27 and is adapted to engage the side of the snowmobile seat 30. Extending horizontally from the upper end of vertical section 29 is an upper section 31 that is adapted to engage the upper surface of seat 30. A suitable pad or cushion 32 is attached over the sections 27, 29 and 31 to prevent damage to the snowmobile components.

Figure 5:
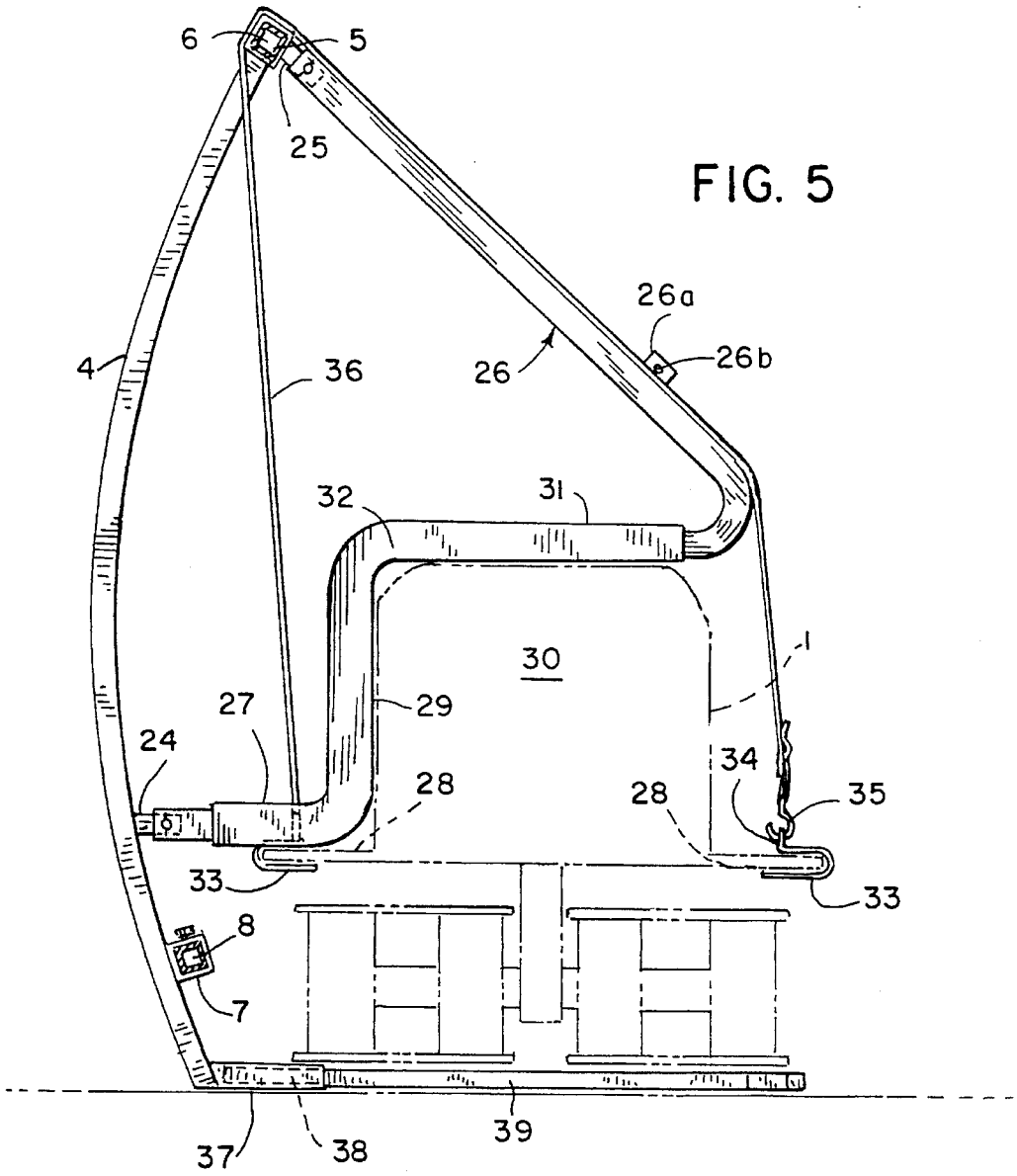
FIG. 5 is a section taken along line 5—5 of FIG. 2.
Figure 6:
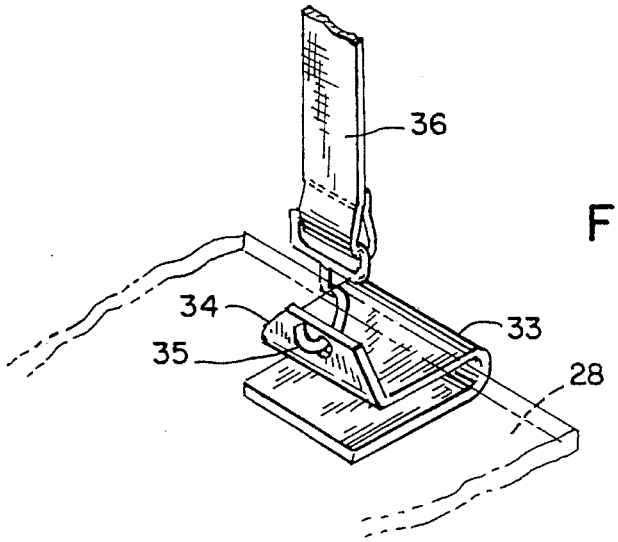
FIG. 6 is a perspective view showing the attachment of the clamping strap to the snowmobile.

A flexible clamping mechanism is employed to clamp the rear portion of the snowmobile to the support bar 26. In this regard a U-shaped clip 33 is removably attached to the running board 28 on each side of the. snowmobile. Each clip 33 is provided with an upwardly extending leg 34 having a hole to receive a hook 35 on the end of a take-up strap 36. As shown in FIGS. 1 and 5, the strap 36 extends from one clip 33 over the upper connecting bar 6 and downwardly to the clip 33 on the opposite side of the snowmobile, as best shown in FIG. 5. Tabs 26*a* project upwardly from opposite sides of frame member 26 and a bolt 26*b* is connected between tabs 26*a*. Strap 36 extends through the space between bolt 16*b* and frame member 26 and thus retains the strap on the frame member. Clamping strap 36 is preferably a ratchet type and by tightening the strap, the rear portion of the snowmobile will be urged upwardly into tight engagement with support bar 26, thus preventing the rear portion of the snowmobile from shifting laterally relative to the frame, as the rack is rotated.

Figure 7:
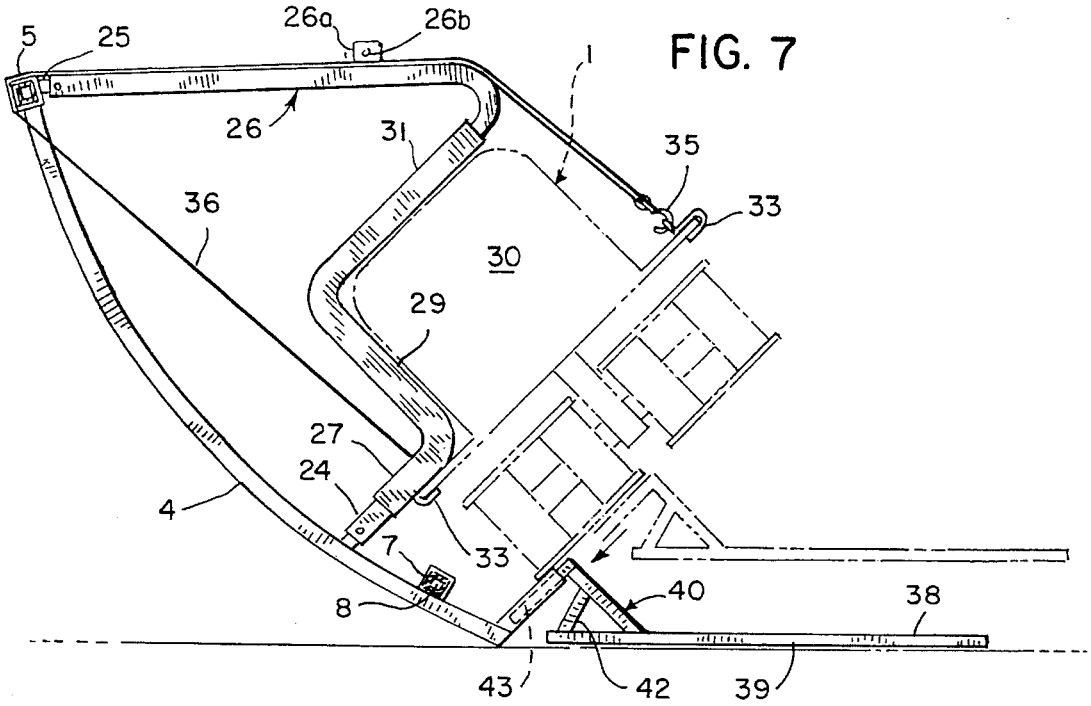
FIG. 7 is a view similar to FIG. 6 and showing the snowmobile in a tilted position.

Connected to the lower end of the rear frame member 4 is a square tubular member 37 that is adapted to receive the square end 38 of an elongated bar 39. As shown in FIG. 1, bar 39 is positioned beneath the track of the snowmobile 1. The opposite or distal end of bar 39 is formed with a laterally extending projection 40 composed of a diagonal leg 41 that extends diagonally outward from bar 39. Brace 42 connects leg 41 and bar 39. In addition, a second leg 43 extends outwardly from the end of leg 41 at an angle of about 90°, as best shown in FIG. 5. Initially, the end 38 of bar 39 is engaged with the tube 37 and the bar 39 is located beneath the track of the snowmobile with the lateral projection 40 extending horizontally so that it will not provide an obstruction to the track, as pictured in FIG. 5. With snowmobile firmly clamped to the frame 2, the frame is manually rotated to tilt the snowmobile. If the snowmobile is tilted to an angle of about 45°, the frame 2 will tend to rotate back to its original position, unless it is chocked or maintained at the tilted position. To provide chocking for the tilted frame 2, the end 38 of bar 39 is removed from lower tube 37, the bar is rotated 90° and reversed, and the leg 43 is inserted in the tube 37, as illustrated in FIG. 7. With this arrangement, the upstanding projection 40 provides an abutment to chock or hold the frame in the tilted position.

Figure 9:
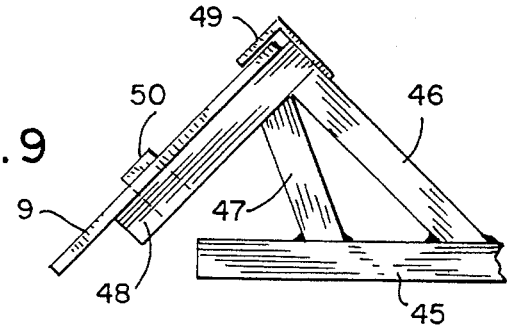
FIG. 9 is an enlarged view of the area shown by line 9—9 of FIG. 8.
Figure 8:
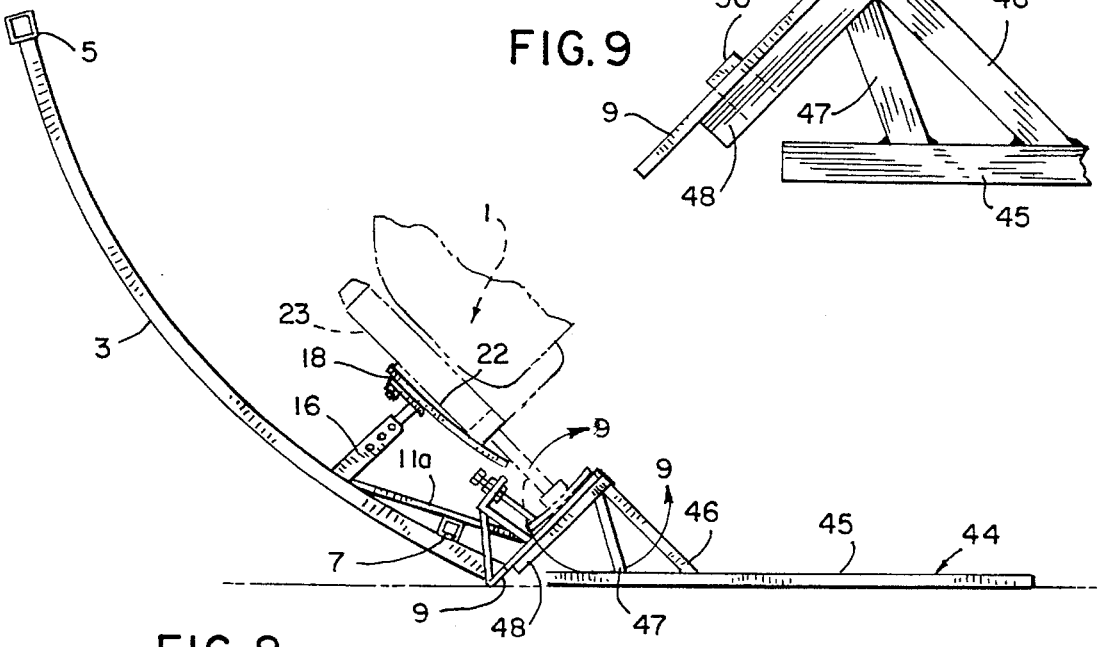
FIG. 8 is a view similar to FIG. 3 and showing the snowmobile in the tilted position.
Figure 11:
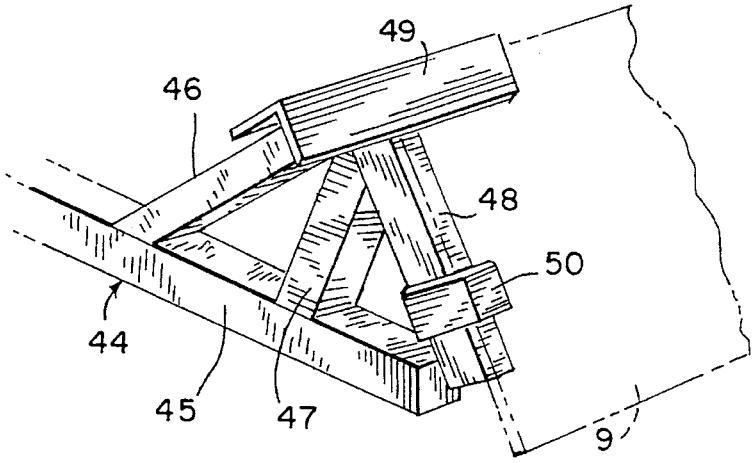
FIG. 11 is a perspective view of the front chocking mechanism.
Figure 13:
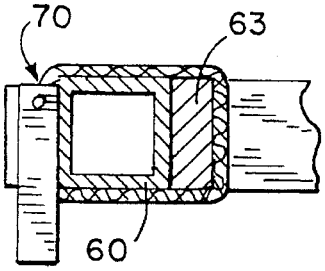
FIG. 13 is a sectional view of the rear bumper clamping strap.

In addition, a second chocking member 44 can be connected to the front frame member 3 when the frame is in the 45° tilted position. As shown in FIGS. 8 and 9, the chock member 44 includes an elongated bar 45, and a leg 46 extends diagonally upward from one end of bar 45 and is supported by a brace 47 that extends between the leg 46 and bar 45. In addition, a second leg 48 projects outwardly at an angle of about 90° from the end of leg 46. As best seen in FIG. 9, one leg of an angle bracket 49 is secured to the leg 46, while the other leg of the angle bracket is spaced from leg 48. The edge of base plate 9 is inserted within the space between angle bracket 49 and leg 48. In addition, an angle bracket 50 is attached to a side of leg 48 and is spaced from the upper surface of the leg. The edge of base plate 9 is received in the space. The engagement of the chock member 44 with plate 9 prevents the frame and snowmobile from rolling back to the original position.

If the frame is rotated to an angle of 90°, chocking is not normally necessary since the center of gravity of the snowmobile will maintain the snowmobile in the tilted position.

In operation of the apparatus of the invention, the frame is initially positioned laterally of the snowmobile and the ski 15 is manually lifted to insert the base plate 9 beneath the ski. Clamping screws 13 are then turned down to clamp the ski against the base plate. Support bar 19 is then adjusted in position so that it engages the outer surface of the suspension 23.

The rear end of the snowmobile is then slightly elevated and bar 39 which is connected to tube 37 of rear frame member 4 is positioned beneath the snowmobile track. At this time, the projection 40 is positioned flat against the terrain so that it does not project upwardly above bar 39. The strap 36 is then engaged with the clips 33 that are removably connected to the running board 38 of the snowmobile and the strap is positioned over the upper connecting bar 6. By tightening the strap 36, the rear portion of the snowmobile will be urged tightly against the support bar 26.

As the snowmobile is then firmly clamped to the frame, the frame can then be rotated to tilt the snowmobile. As previously described, if the snowmobile is only tilted to approximately 45°, the bar 39 can be removed from tube 37, rotated 90° and reversed to enable the projection 40 to serve a chocking function, as shown in Fig. 7. Similarly the chock member 44 can be engaged with the edge of the base plate 9 at the front end of the frame. As previously noted, if the snowmobile is tilted to approximately 90°, no chocking is normally necessary.

The apparatus of the invention enables the snowmobile to be tilted to a position where the track and suspension on the undersurface of the snowmobile are accessible and can be serviced and prevents possible damage to components of the snowmobile.

The frame can be readily rotated manually and adjusted to accommodate different sizes and models of snowmobiles, as well as different suspension systems.

Figure 12:
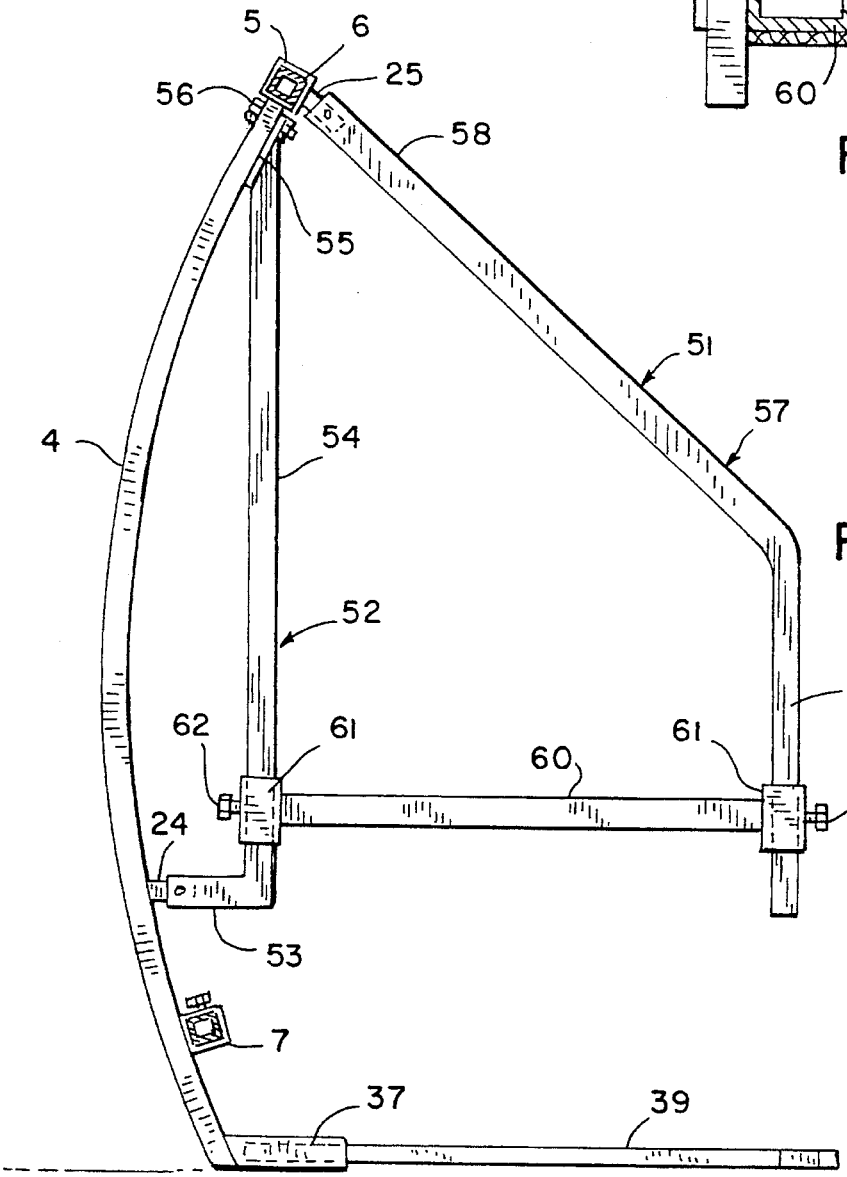
FIG. 12 is a side elevational view of a modified form of the invention

FIG. 12 shows a modified form of the invention in which the rear frame member 4 is secured to the rear bumper of the snowmobile. In this embodiment, support bar 26 is replaced by a rear support structure 51. support structure 51 includes an L-shaped tubular member 52 and the lower leg 53 of L-shaped member 52 is telescopically connected to tube 24, while the upwardly extending leg 54 of member 52 carries a plate 55 that is connected to the upper end portion of frame member 4 by bolt 56.

A second member 57 has an upper end 58 connected to tube 25, while the lower leg 59 of member 57 is parallel to leg 54 and a bar 60 is adjustably connected between legs 54 and 59. In this regard, tubes 61 are secured to the ends of bar 60 and are slidable on legs 54 and 59, respectively, and thumb screws 62 are employed to clamp the tubes 61 to the legs.

The frame member 4 is positioned so that it is located laterally of the rear end of the snowmobile 1 and the support structure 51 is connected to the frame member. The bar 60 is then adjusted in height so that it is adjacent the rear bumper 63 of the snowmobile, and the bar is then secured to the rear bumper 63 by a suitable clamping mechanism, such as a ratchet-type clamping strap 70. With the ski 15 clamped to the front frame member 3 and the bumper 63 secured to the rear frame member 4, the snowmobile can then be manually rotated, as previously described, for service or repair.

Various modes of carrying out the invention are contemplated as being within the scope of the following claims particularly pointing out and distinctly claiming the subject matter which is regarded as the invention.

I claim:

1. A rotary apparatus for servicing a vehicle such as a snowmobile, comprising a frame including a pair of generally parallel curved frame members disposed laterally of a snowmobile, each frame member having a lower end and an upper end, connecting means for connecting the frame members together, a base plate secured to the lower end of a first of said frame members and disposed to be positioned beneath the ski of the snowmobile, first clamping means connected to the first frame member for clamping the ski to said base plate, first support means on said first frame member above said base plate and including a cushioned surface disposed to engage a side portion of the snowmobile, second support means connected to the second frame member and disposed adjacent the rear portion of the snowmobile, and second clamping means for connecting the rear portion of the snowmobile to said second support means, said frame being rotatable from a first position where said base plate is disposed generally horizontal to a second position where said base plate is at an angle to the horizontal.

2. The apparatus of claim 1, wherein said first support means includes a support member disposed inwardly of said first frame member in a direction toward said snowmobile, said cushioned surface being connected to said support member, and adjusting means for adjusting the position of said support member relative to said first frame member.

3. The apparatus of claim 2, wherein said adjusting means comprises a socket on said first frame member to receive an end of said support member, one of said socket and said end having a recess of polygonal cross section and the other of said socket and said end having a complementary polygonal exterior surface to be received within said recess.

4. The apparatus of claim 3, wherein said recess is in said socket and said exterior surface is on said support member.

5. The apparatus of claim 3, wherein said polygonal cross section comprises a square cross section.

6. The apparatus of claim 1, wherein said second clamping means comprises a strap connected between said snowmobile and said frame.

7. The apparatus of claim 1, wherein said second support means includes a first generally horizontal section connected to the lower portion of said second frame member and disposed to engage a running board on said snowmobile, said second support member including a second generally vertical section extending upwardly from said horizontal section and disposed to engage a side of a seat on the snowmobile, said second support member further including a third generally horizontal section extending inwardly from an upper end of said vertical section and disposed to engage the upper surface of said seat.

8. The apparatus of claim 1, and including an elongated horizontal member connected to a lower end of said second frame member and disposed on the terrain beneath a track of said snowmobile.

9. The apparatus of claim 8, and including means for removably connecting said elongated member to said second frame member.

10. The apparatus of claim 8, wherein said elongated member includes a first straight end and a second end having a lateral projection, means for removably connecting said first straight end to said second frame member, and means for removably connecting said second end to said second frame member on removal of said first straight end from said second frame member, attachment of said second end to said second frame member providing an upwardly extending abutment to prevent the frame from rolling from a tilted position back to its original position.

11. The apparatus of claim 1, and including chocking means disposed between the lower end of one of said frame members and the terrain for preventing the frame from rolling back from a tilted position to its original position.

12. A rotary apparatus for servicing a snowmobile, comprising a tubular frame including a pair of generally parallel curved frame members disposed laterally of a snowmobile, each frame member having a lower end and an upper end, an upper connecting member connecting the upper ends of the frame members, a lower connecting member for connecting the lower ends of the frame members, a base plate secured to the lower end of a first of said frame members and disposed to be positioned beneath the ski of the snowmobile, first clamping means connected to the first frame member for clamping the ski to said base plate, first support means disposed on said first frame member above said base plate and including an adjustable cushioned surface disposed to engage the suspension of said snowmobile, second rigid support means connected to said second frame member and including a first horizontal section connected to a lower portion of said second frame member and disposed to engage a running board on said snowmobile, said second support means also including a second generally vertical section extending upwardly from said first horizontal section and disposed to engage a side of a seat on the snowmobile, said second support means also including a third horizontal section extending inwardly from an upper end of said second vertical section and disposed to engage the upper surface of said seat, and flexible second clamping means connecting the frame to opposite sides of said snowmobile for clamping the rear portion of said snowmobile to said second support means.

13. The apparatus of claim 12, wherein said first support means comprises a tubular member having a square cross section and connected to said first frame member, a connecting bar having a square cross section and having a first end to be received in said tubular member, a plate connected to a second end of said connecting bar, a support member adjustably connected to said plate at a location offset from the connection of said connecting bar on said plate and including said cushioned surface, whereby removal, rotation and reinsertion of said bar with respect to said tubular member and adjustment of said support member relative to said plate enables the cushioning surface to be selectively positioned relative to said snowmobile suspension.

14. The apparatus of claim 13, and including adjusting means for adjusting the length of the connecting bar received in said tubular member.

15. The apparatus of claim 11, wherein said chocking means comprises a chocking member disposed to rest on the terrain and engageable with an edge of said base plate when the frame is in a tilted condition.

16. The apparatus of claim 1, wherein said second support means includes a support structure removably connected to said second frame member, said support structure having a generally horizontal bar, and adjusting means for adjusting the vertical height of said bar relative to said support structure, said clamping means connecting said bar to the rear portion of the snowmobile.

17. The apparatus of claim 1, wherein said second support means includes a support structure removably connected to said second frame member, said support structure having a generally horizontal bar, and adjusting means for adjusting the vertical height of said bar relative to said support structure.

* * * * *